US005288305A

United States Patent [19]

Gellert et al.

[11] Patent Number: 5,288,305

[45] Date of Patent: Feb. 22, 1994

[54] METHOD FOR CHARGING PARTICLES

[75] Inventors: Bernd Gellert, Wettingen; Andreas Kwetkus, Mellingen, both of Switzerland

[73] Assignee: Asea Brown Boveri Ltd., Baden, Switzerland

[21] Appl. No.: 884,198

[22] Filed: May 18, 1992

[51] Int. Cl.[5] ..... B03C 3/38

[52] U.S. Cl. ..... 95/57; 95/79; 96/16; 96/17; 96/77

[58] Field of Search ..... 55/2, 102, 107, 150, 55/136-138; 313/634, 621, 607, 231.71; 96/16, 17, 77; 95/57, 79

[56] References Cited

U.S. PATENT DOCUMENTS

| | | | |
|---|---|---|---|
| 3,403,252 | 9/1968 | Nagy | 55/102 X |
| 3,653,185 | 4/1972 | Scott et al. | 55/102 X |
| 4,102,654 | 7/1978 | Pellin | 96/16 |
| 4,574,004 | 3/1986 | Schmidt-Ott et al. | 55/102 X |
| 4,726,812 | 2/1988 | Hirth | 55/2 |
| 4,750,917 | 6/1988 | Fujii | 55/102 X |
| 4,837,484 | 6/1989 | Eliasson et al. | 313/634 |
| 4,876,852 | 10/1989 | Abthoff et al. | 96/16 X |
| 5,060,805 | 10/1991 | Fujii et al. | 55/2 X |

FOREIGN PATENT DOCUMENTS

| | | | |
|---|---|---|---|
| 0241555 | 10/1987 | European Pat. Off. . | |
| 0254111 | 1/1988 | European Pat. Off. . | |
| 394577 | 4/1924 | Fed. Rep. of Germany . | |
| 744361 | 9/1944 | Fed. Rep. of Germany . | |
| 1084246 | 6/1960 | Fed. Rep. of Germany . | |
| 3611947 | 10/1987 | Fed. Rep. of Germany . | |
| 3711312 | 10/1988 | Fed. Rep. of Germany | 55/102 |
| 4022279 | 2/1991 | Fed. Rep. of Germany . | |
| 4010190 | 10/1991 | Fed. Rep. of Germany . | |
| 1-266864 | 10/1989 | Japan | 55/102 |
| 848687 | 9/1960 | United Kingdom | 55/102 |

OTHER PUBLICATIONS

ESB, Meersburg, "ESB Electrostatik-Automatik-Pulverbeschichtungs-Systeme", Undated.

*Primary Examiner*—Richard L. Chiesa

*Attorney, Agent, or Firm*—Oblon, Spivak, McClelland, Maier & Neustadt

[57] ABSTRACT

In order to enhance the efficiency of charging in a friction charger, it is proposed to precharge the particles before the first collision with the walls by making use of the photoeffect. This is performed, preferably, through irradiating the particles using UV radiation from a UV excimer radiator.

4 Claims, 2 Drawing Sheets

METHOD FOR CHARGING PARTICLES

BACKGROUND OF THE INVENTION

1. Field of the Invention

The invention relates to a method for charging particles by charging the particles in a friction charger and subsequent separation.

The invention further relates to a device for carrying out the method.

2. Discussion of Background

In the electrostatic separation of particles, for example coal particles, finely ground particles are charged in a friction charger (TRIBOcharger) by collisions with solid bodies, for example walls. Friction chargers of this type are described, for example, in the brochure "ESB Electrostatik-Automatik-Pulverbeschichtungs-Systeme" (ESB Electrostatic Automatic Powder-coating Systems), page 13, from the firm ESB, Meersburg (FRG), undated. This charging depends strongly on the dielectric characteristics of the particles. A good insulator will be differently charged in this case than a poor insulator, so that the good insulator material can be separated from the poor insulating material in an electric field. Depending on the combination of the materials to be separated it is even possible for chargings of different polarity to occur. Further charges are brought onto the particles by a plurality of collisions; however, the number is no longer as large as in the case of earlier collisions, because saturation is finally achieved. The aim of the efficient friction chargers is to achieve this "maximal" charge density by as few collisions as possible.

SUMMARY OF THE INVENTION

Accordingly, an object of this invention is to provide a novel method for efficiently charging particles. It is a further object of the invention to create a device suitable for carrying out the method.

According to the invention, these objects are achieved in a method of the generic type mentioned above when the particles are precharged by irradiation using UV radiation, before the definitive charging is performed in the friction charger.

This mode of procedure yields a high charging efficiency. Moreover, there is a positive change in the physical mechanism (the work function of electrons of the material) of the charge transfer for precharged particles in the friction charger. In substrate combinations in which charging of different polarity occurs, it is possible, for example in the case of positive preliminary charging for the charge difference achieved between the particles upon collision with the neutral wall (in the friction charger) to be particularly amplified, because one polarity discharges while the other obtains additional charges. A better selectivity is achieved as a result.

In the case of electrostatically supported, mechanical filter elements, it is certainly known from DE-A-3,611,947 for the solid particles contained in the stream of gas to be electrostatically precharged in a first stage by means of a UV source before they are charged once again in a second stage by means of an ion-generating device, in order thereafter to be fed to the mechanical filter element. However, in physical terms precharging for frictional charging is a different phenomenon. Here, the electron distribution at the surface is varied such that the charge exchange no longer obeys the simple laws in the case of contact charging which are specified by work functions.

It is particularly advantageous when precharging is performed by means of a UV excimer radiator, such as is described in U.S. Pat. No. 4,837,484, EP-A-0,254,111, for example. These new UV excimer radiators generate high-energy UV radiation in a well defined waveband, and can easily be adapted to the process with respect to their geometry. The main advantage of these radiators resides in that the radiation has a very narrow-band (monochromatic), so that entirely specific energies of the photons are emitted. It is therefore possible to charge very effectively and selectively.

It is further advantageous when the charging of the particles in the friction charger is supported by an electric field and the charged particles are separated from as yet uncharged particles after leaving the friction charger by the effects of an electric field of reverse polarity.

The method according to the invention is particularly suitable for selectively charging ash-forming and sulphur-containing constituents in pulverised coal, because these constituents are charged in a different fashion than particles which virtually consist entirely only of coal.

The device for carrying out the method according to the invention essentially comprises a UV radiator, preferably a UV excimer radiator, through whose irradiation space the stream of particles to be irradiated can be led, which radiator is connected directly upstream of a friction charger. In this case, the UV excimer radiator is preferably constructed as a cylinder/inner radiator and has two concentric dielectric tubes of which the one facing the irradiation space consists of a dielectric material, preferably quartz. The surface, facing the irradiation space, of the inner tube is provided with an electrode that is transparent to UV radiation. The other tube consists of metal or equally of dielectric material that is provided outside with an electrode. The downstream friction charger essentially comprises a cylindrical tube having an inside diameter which corresponds approximately to the width in the clear of the irradation space of the UV radiator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
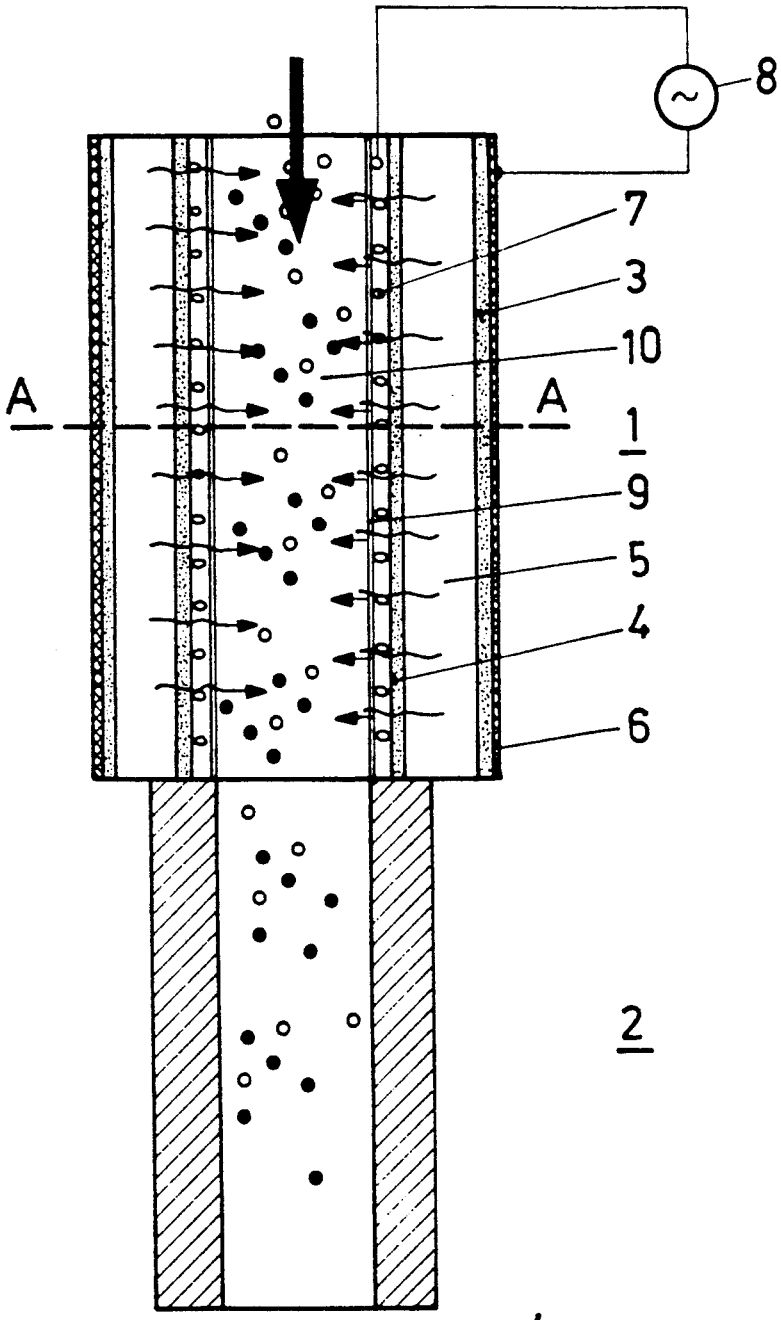
FIG. 1 shows in a diagrammatic form a device for electrostatically charging particles, consisting of a UV radiator having a downstream friction charger.
Figure 2:
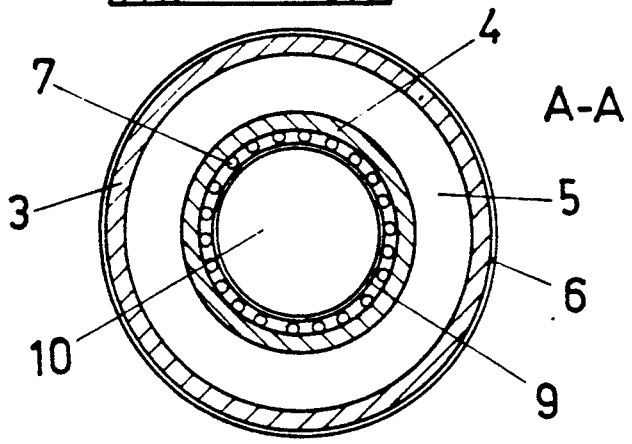
FIG. 2 shows a cross section through the device according to FIG. 1 along the line AA thereof.

Referring now to the drawings, wherein like reference numerals designate identical or corresponding parts throughout the several views, the device for charging particles represented in FIG. 1 comprises a UV irradiation device 1 and a friction charger 2 directly joined thereto. The UV irradiation device consists of two concentric quartz tubes 3, 4 which leave free between themselves as an annular space, the discharge space 5. The outer quartz tube 3 is provided outside with a metallic coating 6 which serves as outer electrode. It is also possible to use a metal tube or metal grid instead of a quartz tube 3 provided with a metallic coating 6.

Arranged on the inner wall, facing the discharge space 5, of the inner tube 4 is an inner electrode 7 which has the form of wire netting and is transparent to UV radiation. A high-voltage source 8 is connected to the two electrodes 6 and 7 in such a way that the inner electrode 7 is at ground potential. A protective tube 9 made from quartz covers the inner electrode 7 inwards. The interior of the protective tube 9 forms the irradiation space 10.

The discharge space 5 is filled with a gas or gas mixture forming excimers under discharge conditions. UV excimer radiators of the type described are known and are the subject matter of the European Patent Application mentioned above, where there is also a detailed description of the gases or gas mixtures in the discharge space 5 in relation to the wavelength of the UV radiation generated.

Other configurations are also suitable apart from the embodiment of the UV radiator 1 represented, for example UV excimer radiators as they are described in German Offenlegungsschriften 4,010,190 or 4,022,279.

The friction charger 2 essentially consists of a grounded metal tube 11. Because the contact charging of solids (and particles) depends strongly on the electrical characteristics of the wall material (of the tube 11), the metal tube 11 consists of an alloy of metal with rare-earth elements (La, Ce, Ce/iron), or it has an insert made from such a material.

Figure 3:
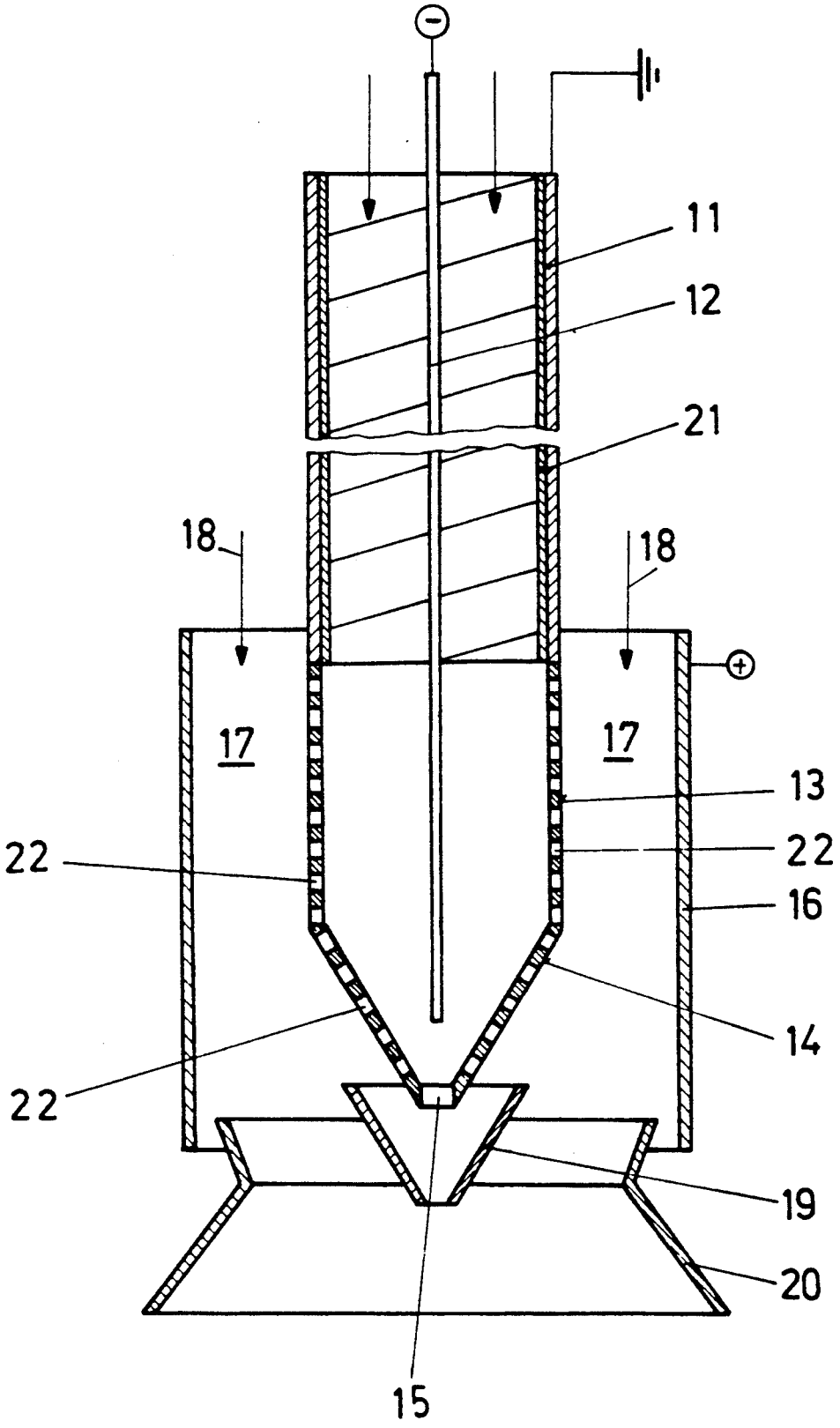
FIG. 3 shows a modification of the device according to FIG. 1 having a field-assisted friction charger.

A particularly advantageous embodiment of a friction charger is produced when the frictional charging is supported by an additional electric field. Such a charger is illustrated by way of example in FIG. 3.

There is arranged in a first tube 11 at ground potential a first electrode 12 that extends in the longitudinal direction of the tube and has a negative potential with respect to ground potential. Joined to the lower end of the tube 11 is a sieve-like attachment 13 that has a funnel-shaped end 14 with an outlet opening 15. The first electrode 12 projects as far as into the funnel-shaped end 14 of the attachment 13.

A second tube 16 surrounds the sieve-shaped attachment 13 coaxially while leaving an annular gap 17 and serves as a second electrode, at a positive potential. The gas stream 18 symbolised by arrows can be introduced into the annular space 17 through this annular gap 17.

A collecting funnel 19 is provided below the outlet opening 15. A rotationally symmetrical guiding device 20 is arranged at the lower end of the second tube 16 and inside thereof.

The first tube 11 consists of a material suitable for optimal frictional charging. Consideration is given in this case, in particular, to alloys of metals with rare-earth elements, such as lanthanum, cerium and cerium-/iron, or metal parts coated or vapor-deposited with rare-earth elements. It is particularly advantageous to insert into the tube 11 an insert 21 made from such a material. In the case of this example, the insert 21 consists of a helically wound metal strip or metal wire which bears everywhere against the inner wall of the tube 11 or is distanced therefrom and is replaceable. In this way, the abrasion of the special material is reduced and the ease of maintenance of the installation is increased. If the individual turns of the insert 21 are not located on one another, an enlargement of the "active" surface area of the insert is produced.

The mode of operation of the device described above emerges from the following:

The mixture containing the particles to be charged is fed in the direction of the arrow at the upper end of the tube 11. The particles are negatively charged by contact with the tube walls. The low work function of the rare-earth elements ensures high negative charging of the particles. The particles thus charged are deflected in the sieve-shaped attachment under the influence of the field acting between inner electrode 12 and outer electrode 16 to the (positive) outer electrode 16 and conveyed through the meshes 22 of the seive-like attachment 13. Before reaching the positive electrode (tube 16), the particles are entrained by the outer gas stream 18, which has a suitable rate of flow, and then removed. Negatively charged particles, which reach the positive electrode, lose their charge, and can be removed from the electrode by suitable devices, for example tapping devices, brushes or similar, and fed once again to the charger. The same holds for particles which have not been sufficiently charged in the charger. These pass through the lower part of the funnel-shaped end 14 into the collecting funnel 19 and are likewise recycled or separated. As a result, a negatively charged flow of particles that contains few or no longer any uncharged particles is generated at the outlet of the charger.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A method for charging particles included in a gas comprising the steps of:

(a) precharging said particles using ultraviolet radiation which is irradiated at said gas containing said particles when said gas is caused to flow through a UV radiation device;

(b) performing additional charging of said particles included in said gas using a friction charging chamber, subsequent to said precharging of said particles using ultraviolet radiation; and (c) separating said charged particles from uncharged particles within said gas and depositing said separated charged particles onto an electrode of opposite polarity from said charged particles subsequent to said additional charging of said particles in said friction charging chamber.

2. The method according to claim 1, wherein said step of additional charging includes charging said precharged particles through frictional contact with the walls of said friction charging chamber, the walls of said friction charging chamber forming an electrode of the same polarity as said precharged particles entering said friction charging chamber such that separation of said charged particles from said uncharged particles does not occur until said additionally charged particles exit said friction charging chamber.

3. The method as claimed in claim 1, wherein the additional charging of the particles in the friction charging chamber is supported by a first electric field interacting with said precharged particles and the additionally charged particles are separated from the uncharged particles after leaving the friction charging chamber by the effects of a second electric field of reverse polarity to the polarity of said first electric field.

4. The method as claimed in claim 3, wherein the additionally charged particles are removed by an air stream that is led outside the friction charging chamber and does not affect the additionally charged particles until after said additional charging is performed in said friction charging chamber.

* * * * *